US006626520B1

(12) United States Patent
Hawkins et al.

(10) Patent No.: US 6,626,520 B1
(45) Date of Patent: Sep. 30, 2003

(54) DROP-ON-DEMAND LIQUID EMISSION USING ASYMMETRICAL ELECTROSTATIC DEVICE

(75) Inventors: Gilbert A. Hawkins, Mendon, NY (US); James M. Chwalek, Pittsford, NY (US); Christopher N. Delametter, Rochester, NY (US); Edward P. Furlani, Lancaster, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/153,990

(22) Filed: May 23, 2002

(51) Int. Cl.[7] ..... B41J 2/04
(52) U.S. Cl. ..... 347/54
(58) Field of Search ..... 347/54, 68, 69, 347/70, 71, 72, 50, 40, 20, 44, 47, 27, 63; 399/261; 361/700; 310/328–330; 29/890.1

(56) References Cited

U.S. PATENT DOCUMENTS

| | | | |
|---|---|---|---|
| 4,520,375 | A | 5/1985 | Kroll |
| 5,644,341 | A | 7/1997 | Fujii et al. |
| 5,668,579 | A | 9/1997 | Fujii et al. |
| 5,739,831 | A | 4/1998 | Nakamura et al. |
| 6,127,198 | A | 10/2000 | Coleman et al. |
| 6,235,212 | B1 | 5/2001 | Silverbrook |
| 6,318,841 | B1 | 11/2001 | Coleman et al. |
| 6,345,884 | B1 | 2/2002 | Yoon et al. |
| 6,357,865 | B1 | 3/2002 | Kubby et al. |
| 6,367,915 | B1 | 4/2002 | Gooray et al. |
| 2001/0023523 | A1 | 9/2001 | Kubby et al. |

OTHER PUBLICATIONS

Rob Legtenberg et al., "Electrostatic Curved Electrode Actuators", vol. 6, No. 3, Sep. 1997, pp. 257–265.

*Primary Examiner*—Raquel Yvette Gordon
(74) *Attorney, Agent, or Firm*—Milton S. Sales

(57) ABSTRACT

A liquid emission device includes a chamber having a nozzle orifice. Separately addressable dual electrodes are positioned on opposite sides of a central electrode. The three electrodes are aligned with the nozzle orifice. A rigid electrically insulating coupler connects the two addressable electrodes. To eject a drop, an electrostatic charge is applied to the addressable electrode nearest to the nozzle orifice, which pulls that electrode away from the orifice, drawing liquid into the expanding chamber. The other addressable electrode moves in conjunction, storing potential energy in the system. Subsequently the addressable electrode nearest to the nozzle is de-energized and the other addressable electrode is energized, causing the other electrode to be pulled toward the central electrode in conjunction with the release of the stored elastic potential energy. This action pressurizes the liquid in the chamber behind the nozzle orifice, causing a drop to be ejected from the nozzle orifice.

14 Claims, 12 Drawing Sheets

DROP-ON-DEMAND LIQUID EMISSION USING ASYMMETRICAL ELECTROSTATIC DEVICE

FIELD OF THE INVENTION

The present invention relates generally to drop-on-demand liquid emission devices such as, for example, ink jet printers, and more particularly such devices which employ an electrostatic actuator for driving liquid from the device.

BACKGROUND OF THE INVENTION

Drop-on-demand liquid emission devices with electrostatic actuators are known for ink printing systems. U.S. Pat. No. 5,644,341 and No. 5,668,579, which issued to Fujii et al. on Jul. 1, 1997 and Sep. 16, 1997, respectively, disclose such devices having electrostatic actuators composed of a single diaphragm and opposed electrode. The diaphragm is distorted by application of a first voltage to the electrode. Relaxation of the diaphragm expels an ink droplet from the device. Other devices that operate on the principle of electrostatic attraction are disclosed in U.S. Pat. No. 5,739,831, No. 6,127,198, and No. 6,318,841; and in U.S. Pub. No. 2001/0023523.

U.S. Pat. No. 6,345,884, teaches a device having an electrostatically deformable membrane with an ink refill hole in the membrane. An electric field applied across the ink deflects the membrane and expels an ink drop. This device is simple to make, but requires a field across the ink and is therefore limited as to the type of ink usable therewith.

IEEE Conference Proceeding "MEMS 1998," held Jan. 25–29, 2002 in Heidelberg, Germany, entitled "A Low Power, Small, Electrostatically-Driven Commercial Inkjet Head" by S. Darmisuki, et al., discloses a head made by anodically bonding three substrates, two of glass and one of silicon, to form an ink ejector. Drops from an ink cavity are expelled through an orifice in the top glass plate when a membrane formed in the silicon substrate is first pulled down to contact a conductor on the lower glass plate and subsequently released. There is no electric field in the ink. The device occupies a large area and is expensive to manufacture.

U.S. Pat. No. 6,357,865 by J. Kubby et al. teaches a surface micro-machined drop ejector made with deposited polysilicon layers. Drops from an ink cavity are expelled through an orifice in an upper polysilicon layer when a lower polysilicon layer is first pulled down to contact a conductor and is subsequently released. There is no electric field in the ink. However, the device requires a high voltage for efficient operation and materials with special elastic module are required for manufacture.

The gap between the diaphragm and its opposed electrode must be sufficiently large to allow for the diaphragm to move far enough to alter the liquid chamber volume by a significant amount. Large gaps require large voltages to move the diaphragm, and large voltages require expensive the circuitry and adds to the assembly process. If the gap is made very small, the motion of the diaphragm is constrained and the area of the device must be made large.

In devices that rely on the elastic memory of the diaphragm to expel liquid drops, the diaphragm must return to its initial position under the force of its own tension and sheer stiffness. This is not always sufficient to overcome stiction; nor is tension and stiffness identical for each membrane.

When the diaphragm is distorted by application of a voltage to the electrode, the diaphragm has a tendency to snap all the way into contact with an underlying substrate as the diaphragm approaches the substrate. This generally occurs during the final third the diaphragm's travel. This part of the motion is not under control.

SUMMARY OF THE INVENTION

According to a feature of the present invention, a drop-on-demand liquid emission device, such as for example an ink jet printer, includes an electrostatic drop ejection mechanism that employs an electric field for driving liquid from a chamber in the device. Structurally coupled, separately addressable first and second dual electrodes are movable in a first direction to draw liquid into the chamber and in a second direction to emit a liquid drop from the chamber. A third electrode between the dual electrodes has opposed surfaces respectively facing each of said first and second electrodes at an angle of contact whereby movement of the dual electrodes in one of the first and second directions progressively increases contact between the first and third electrodes, and movement of the dual electrodes in the direction progressively increases contact between the second and third electrodes.

DETAILED DESCRIPTION OF THE INVENTION

The invention has been described in detail with particular reference to certain preferred embodiments thereof, but it will be understood that variations and modifications can be effected within the spirit and scope of the invention.

As described in detail herein below, the present invention provides an apparatus and method of operating a drop-on-demand liquid emission device. The most familiar of such devices are used as printheads in ink jet printing systems. Many other applications are emerging which make use of devices similar to ink jet printheads, but which emit liquids (other than inks) that need to be finely metered and deposited with high spatial precision. The inventions described below provide apparatus and methods for operating drop emitters based on electrostatic actuators so as to improve energy efficiency and overall drop emission productivity.

Figure 1:
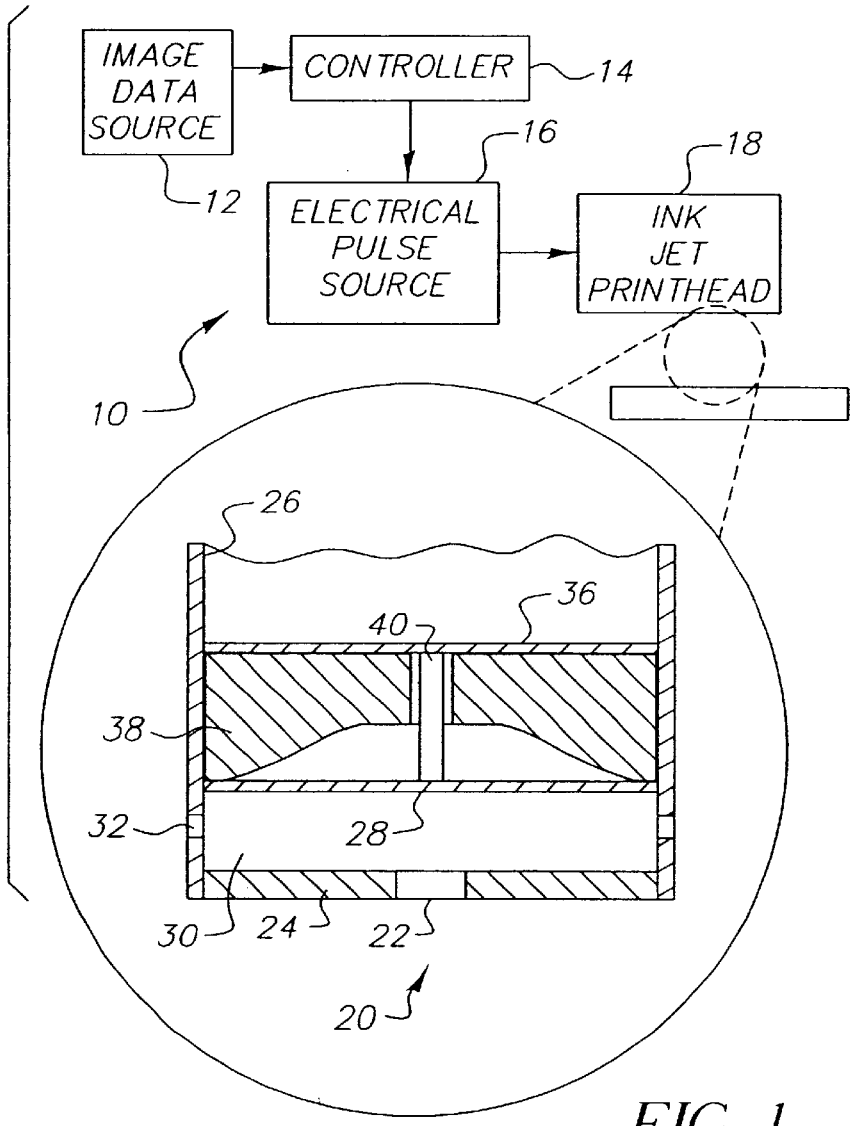
FIG. 1 is a schematic illustration of a drop-on-demand liquid emission device according to the present invention.

FIG. 1 shows a schematic representation of a drop-on-demand liquid emission device 10, such as an ink jet printer, which may be operated according to the present invention. The system includes a source 12 of data (say, image data) which provides signals that are interpreted by a controller 14 as being commands to emit drops. Controller 14 outputs signals to a source 16 of electrical energy pulses which are inputted to a drop-on-demand liquid emission device such as an ink jet printer 18.

Figure 2:
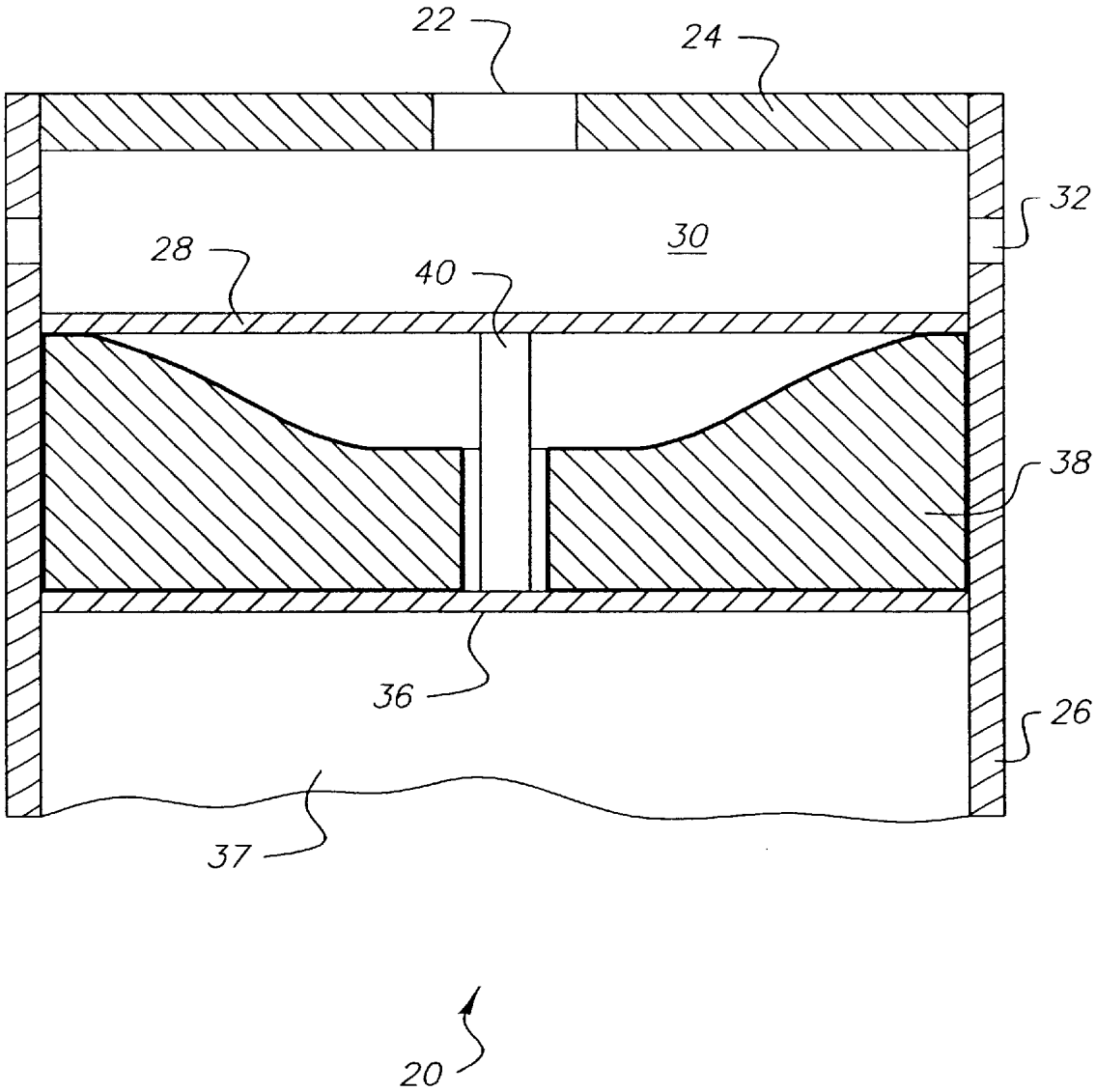
FIG. 2 is a cross-sectional view of a portion of drop-on-demand liquid emission device of FIG. 1.

Drop-on-demand liquid emission device 10 includes a plurality of electrostatic drop ejection mechanisms 20. FIG. 2 is a cross-sectional view of one of the plurality of electrostatically actuated drop ejection mechanisms 20. A nozzle orifice 22 is formed in a nozzle plate 24 for each mechanism 20. A wall or walls 26 that carry an electrically addressable electrode 28 bound each drop ejection mechanism 20.

The outer periphery of electrode 28 is sealingly attached to wall 26 to define a liquid chamber 30 adapted to receive the liquid, such as for example ink, to be ejected from nozzle orifice 22. The liquid is drawn into chamber 30 through one or more refill ports 32 from a supply, not shown, typically forming a meniscus in the nozzle orifice. Ports 32 are sized as discussed below. Dielectric fluid fills the region 34 on the side of electrode 28 opposed to chamber 30. The dielectric fluid is preferably air or other dielectric gas, although a dielectric liquid may be used.

Typically, electrode 28 is made of a somewhat flexible conductive material such as polysilicon, or, in the preferred embodiment, a combination of layers having a central conductive layer surrounded by an upper and lower insulative layer. For example a preferred electrode 28 comprises a thin film of polysilicon stacked between two thin films of silicon nitride, each film for example, being one micron thick. In the latter case, the nitride acts to stiffen the polysilicon film and to insulate it from liquid in the chamber 30. However, due to a coupler, described below, it is not necessary that the polysilicon film be made stiffer, since the electrode may be moved in either direction solely by electrostatic attractive forces.

A second electrode 36 between chamber 30 and a lower cavity 37 is preferably identical in composition to electrode 28, and is electrically addressable separately from electrode 28. Addressable electrodes 28 and 36 are preferably at least partially flexible and are positioned on opposite sides of a single central electrode 38 such that the three electrodes are generally axially aligned with nozzle orifice 22. Since there is no need for addressable electrode 36 to completely seal with wall 26, its peripheral region may by mere tabs tethering the central region of electrode 36 to wall 26.

Central electrode 38 is preferably made from a conductive central body surrounded by a thin insulator of uniform thickness, for example silicon oxide or silicon nitride, and is rigidly attached to walls 26. In a preferred embodiment, the central electrode is curved on one side, shown as the top side in FIG. 2, and is flat on the opposing side, shown as the bottom side in FIG. 2, and is in contact with addressable electrode 36 along its lower surface at walls 26. That is, the upper surface of central electrode 38 is concave away from addressable electrode 28, but the lower surface of central electrode 38 is planar and may be in contact with addressable electrode 36 along its entirety. In accordance with the present invention, the lower side of central electrode 38 is flat and addressable electrode 36 contacts the central electrode at its periphery along sidewall 26 in order to insure that the shape of addressable electrode 36, when in a position away from central electrode 36 (FIG. 6), is determined entirely by the materials properties of addressable electrode 36 and the length that rigid coupler 40 extends below the lower surface of central electrode 38. In this way, the position of addressable electrode 36, when extended downward, as in FIG. 6, will be very nearly identical for all ejectors on a single print head and for ejectors from print head to print head. The force exerted by addressable electrode 36 to expel drops during the drop expulsion portion of operation, as described later, will be nearly identical for all ejectors, irrespective of the exact shape of the curved portion of central electrode 38. As is well known in the art of semiconductor manufacture, a flat surface is more precisely and reliably obtained than a curved surface and films, such as the thin films forming addressable electrode 36, are deposited more consistently and are better understood when deposited on a flat substrate. Thereby the drops from all ejectors will me expelled with nearly identical velocities.

Figure 6:
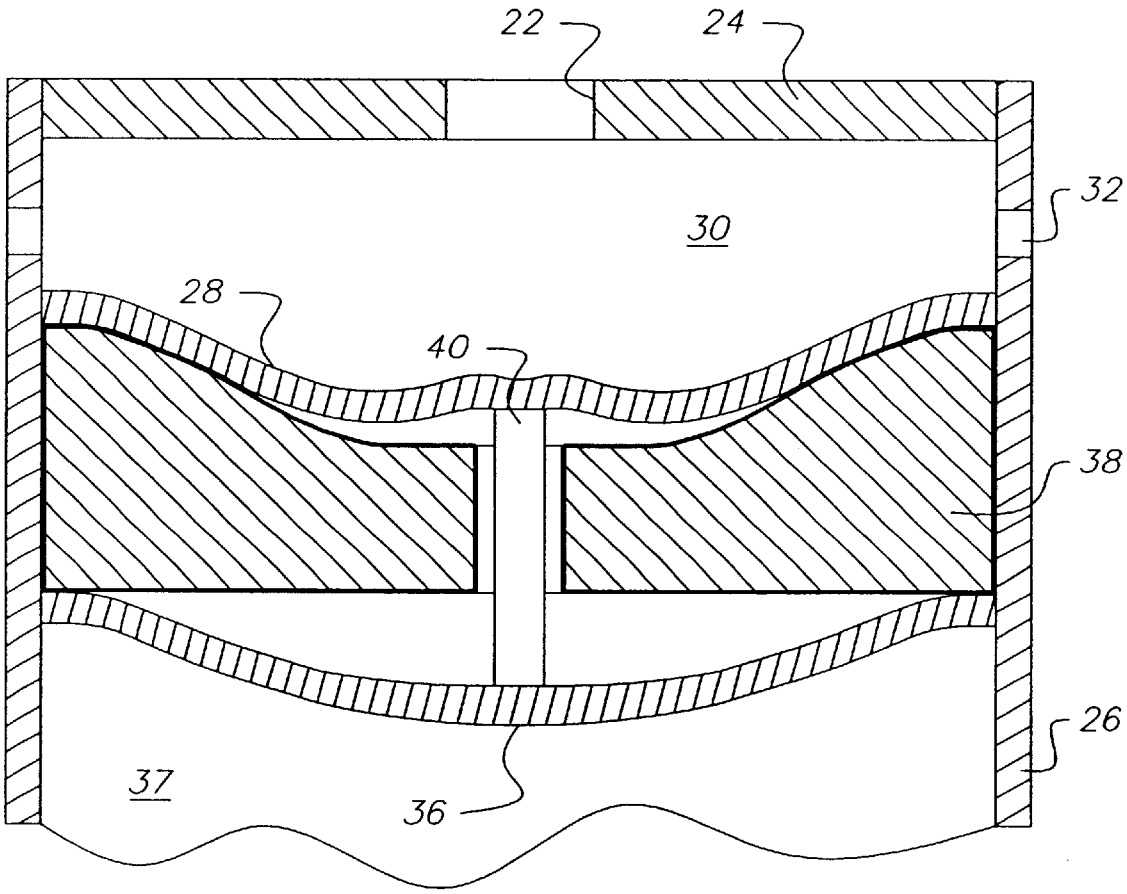
FIG. 6 is a cross-sectional view of the drop-on-demand liquid emission device of FIG. 2 shown in a first actuation stage.
Figure 7:
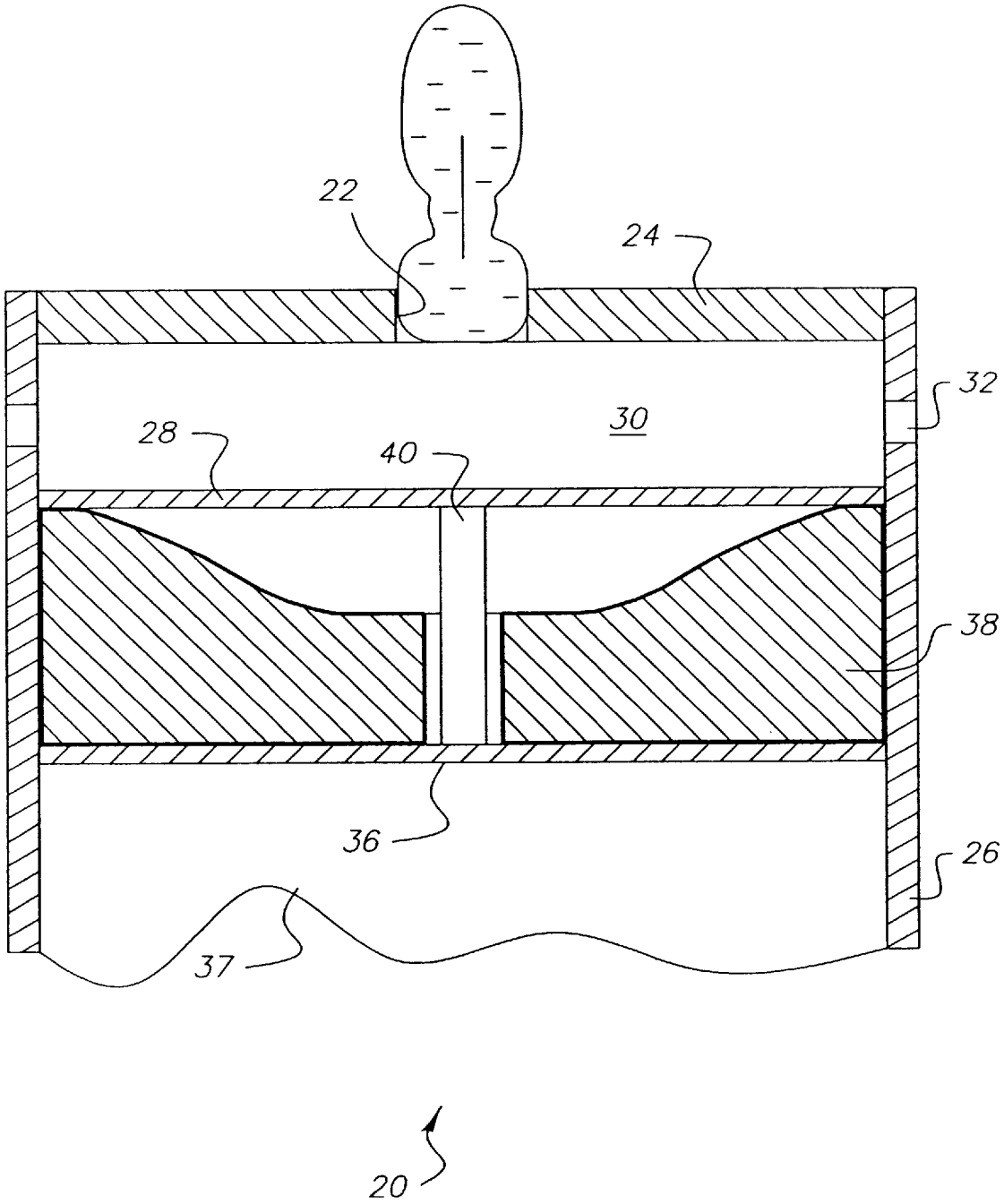
FIG. 7 is a cross-sectional view of the drop-on-demand liquid emission device of FIG. 2 shown in a second actuation stage.

Additionally, due to the flat bottom surface of central electrode 38, addressable electrode 36 has a surface area that is a minimum when the addressable electrode contacts the lower surface of central electrode (FIG. 7). The surface area increases when addressable electrode 36 is pushed away from the central electrode (FIG. 6). Thereby, addressable electrode 36 is assured to contact completely the central electrode during operation, since the portion of addressable electrode 36 last to contact the central electrode will be in a state of lesser tension than if the central electrode were concave, as can be appreciated by one skilled in the theory of elastic deformation. This is opposite to addressable electrode 28 in FIG. 6, which is under its greatest tensile stress while contacting (or attempting to contact) the entire upper side of the central electrode since the surface area of addressable electrode 28 is a maximum when it contacts central electrode 38.

Addressable electrode 28 may not fully contact central electrode 38 unless the voltage differential between them is very large, as shown in FIG. 6, whereas addressable electrode 36 will always contact central electrode 38, even for small voltage differentials between them. Thus, during the drop expulsion portion of operation, as described later, both addressable electrodes will be exerting a force to increase the pressure in ink cavity 30 because of their elastic properties as well as the voltage differential between the addressable electrode 36 and central electrode 38.

The two addressable electrodes are structurally connected via a rigid coupler 40. This coupler is electrically insulating, which term is intended to include a coupler of conductive material but having a non-conductive break therein. Coupler 40 ties the two addressable electrodes structurally together and insolates the electrodes so as to make possible distinct voltages on the two. The coupler may be made from conformally deposited silicon dioxide.

Figure 5:
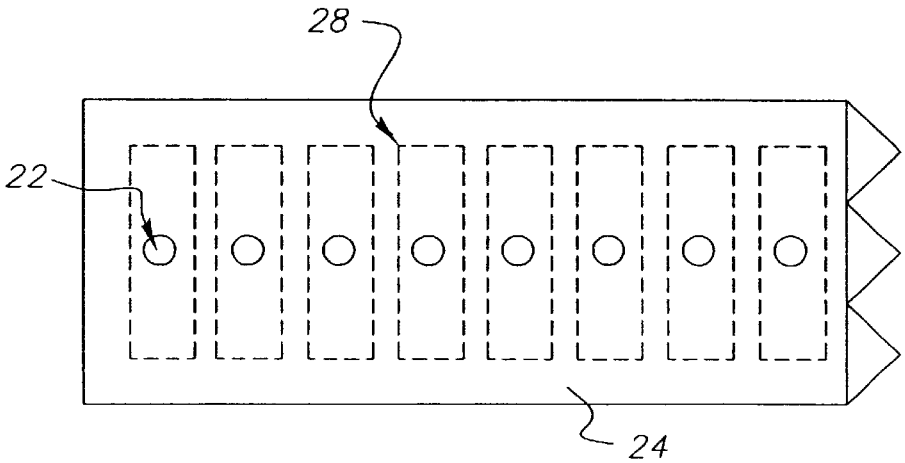
FIGS. 3–5 are top plan views of alternative embodiments of a nozzle plate of the drop-on-demand liquid emission device of FIGS. 1 and 2.
Figure 3:
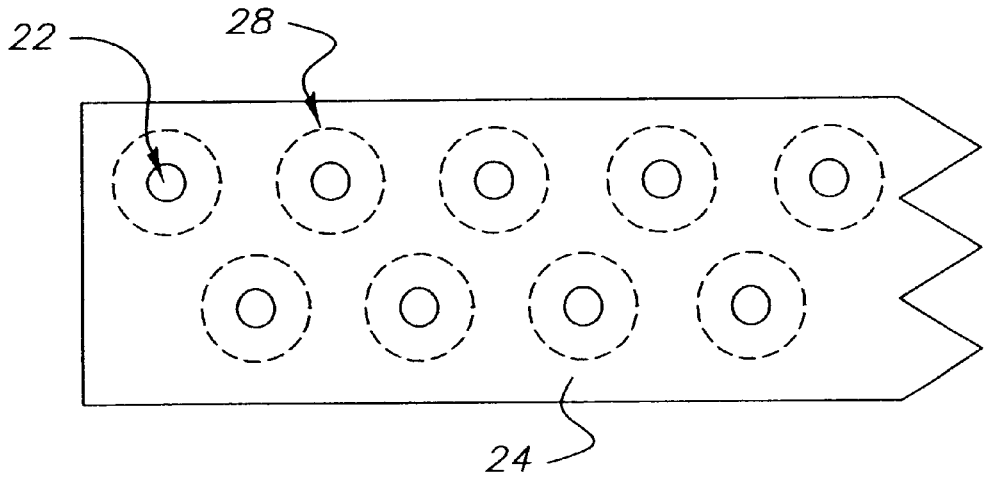
Figure 4:
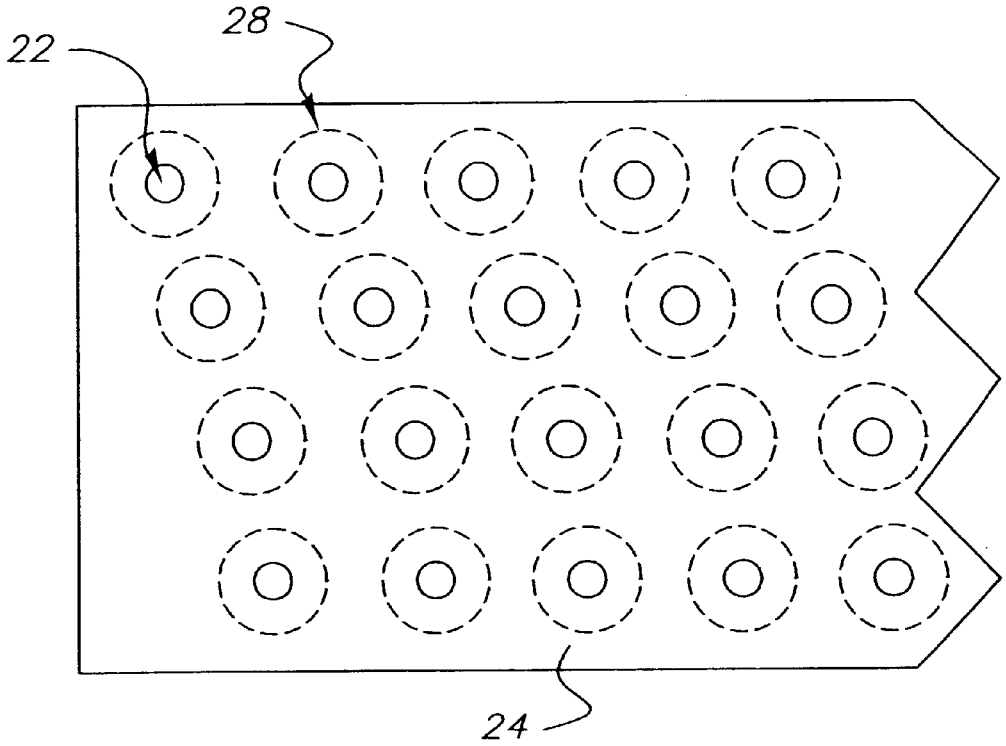

FIGS. 3–5 are top plan views of nozzle plate 24, showing several alternative embodiments of layout patterns for the several nozzle orifices 22 of a print head. Note that in FIGS. 2 and 3, the interior surface of walls 26 are annular, while in FIG. 5, walls 26 form rectangular charnbers. Other shapes are of course possible, and these drawings are merely intended to convey the understanding that alternatives are possible within the spirit and scope of the present invention.

Referring to FIG. 6, to eject a drop, an electrostatic charge is applied to the polysilicon portion of addressable electrode 28 nearest to nozzle orifice 22 and the conductive portion of central electrode 38. The voltage of the conductive body of central electrode 38 and of the polysilicon portion of addressable electrode 36 are kept at the sane. As shown in FIG. 6, addressable electrode 28 is attracted to central electrode 38 until it is deformed to substantially the surface shape of the central electrode, except in the region very near the central opening in the central electrode. In so conforming its shape, addressable electrode 28 presses down on addressable electrode 36 through rigid coupler 40, thereby deforming addressable electrode 36 downward, as shown in FIG. 6, and storing elastic potential energy in the system. Since addressable electrode 28 forms a wall portion of liquid chamber 30 behind the nozzle orifice, movement of electrode 28 away from nozzle plate 24 expands the chamber, drawing liquid into the expanding chamber through ports 32. Addressable electrode 36 does not receive an electrostatic charge, that is, its voltage is the same as electrode 38, and moves in conjunction with addressable electrode 28.

The angle of contact between the lower surface of addressable electrode 28 and the upper surface of central electrode 38 is preferably less than 10 degrees. In a preferred embodiment, this angle tends to 0 degrees at the point of contact between the lower surface of addressable electrode 28 and the upper surface of central electrode 38. This ensures the voltage difference required to pull addressable electrode 28 down into contact with central electrode 38 is small compared with the value that would be required if the angle were larger than 10 degrees. For example, for the shape of central electrode 38 shown in FIG. 6, the voltage required is typically less than half that required for the case in which the angle of contact between the lower surface of addressable electrode 28 and the upper surface of central electrode 38 is 90 degrees, as can be appreciated by one skilled in the art of electrostatically actuators.

Subsequently (say, several microseconds later) addressable electrode 28 is de-energized, that is, its voltage is the same as electrode 38, and addressable electrode 36 is energized, causing addressable electrode 36 to be pulled toward central electrode 38 in conjunction with the release of the stored elastic potential energy. The timing of the de-energization of electrode 28 and the engization of electrode 36 may be simultaneous, or there may be a short dwell period therebetween so that the structure begins to move from the position illustrated in FIG. 6 toward the position illustrated in FIG. 7 under the sole force of stored elastic potential energy in the system. Still referring to FIG. 7, this action pressurizes the liquid in chamber 30 behind the nozzle orifice, causing a drop to be ejected from the nozzle orifice. To optimize both refill and drop ejection, ports 32 should be properly sized to present sufficiently low flow resistance so that filling of chamber 30 is not significantly impeded when electrode 28 is energized, and yet present sufficiently high resistance to the back flow of liquid through the port during drop ejection.

The lower surface of central electrode 38 is planar, reducing the dependence of the displaced liquid volume during the ejection stroke on fabrication parameters, and allowing addressable electrode 28 to be planar at the peak of ejection height. In comparison with a symmetric central electrode having two concave surfaces, fabrication is simpler and less subject to process variations. Further, the onset of the ejection stroke is more precisely controlled.

Figure 8:
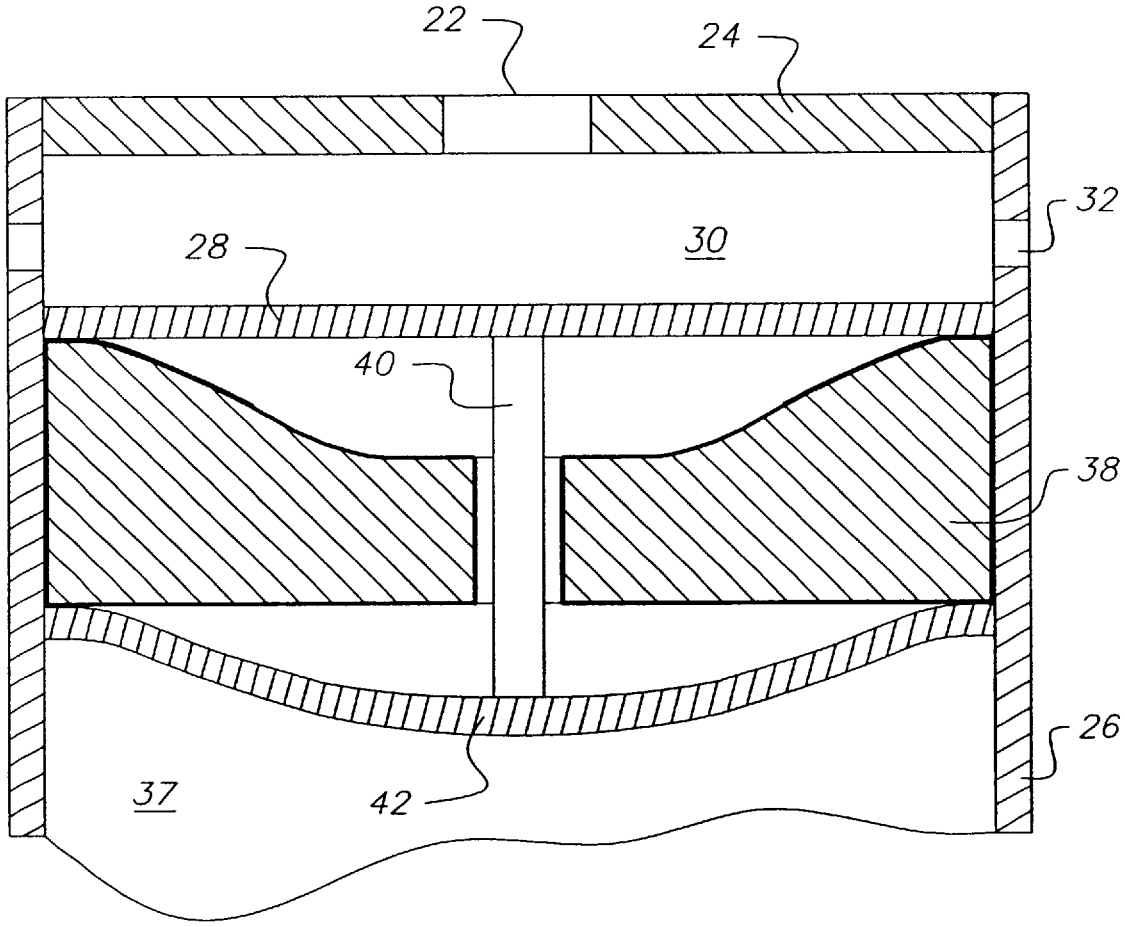
FIG. 8 is a cross-sectional view of a portion of another embodiment of the drop-on-demand liquid emission device of FIG. 1.
Figure 9:
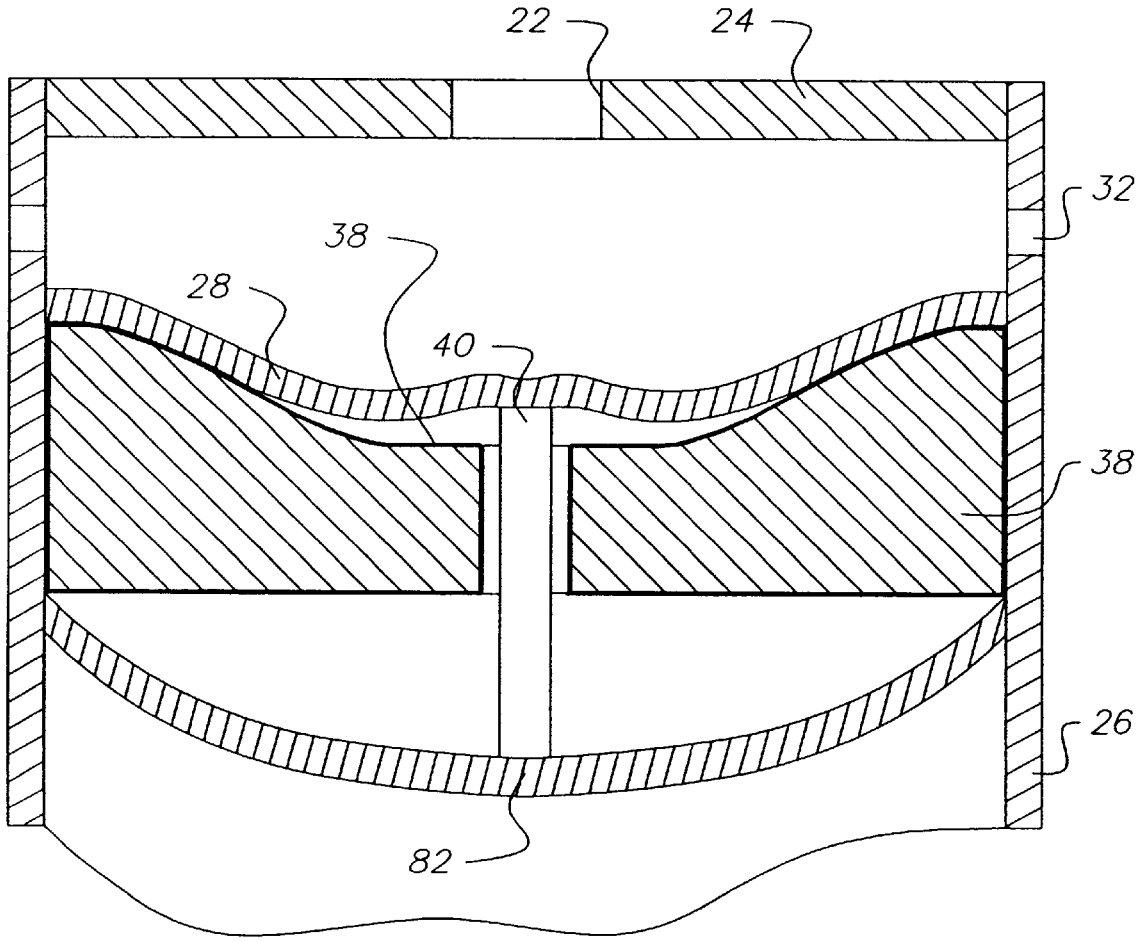
FIG. 9 is a cross-sectional view of the drop-on-demand liquid emission device of FIG. 8 shown in a first actuation stage.

Another Preferred Embodiment:

In the embodiment illustrated in FIG. 2, addressable electrode 36 is flat and parallel to the lower surface of central electrode 38 at the operational stage prior to application of a voltage between electrode 28 and the central electrode. This need not be the case. Another preferred embodiment of a liquid emission device in accordance with the present invention is shown in FIGS. 8 and 9, wherein addressable electrodes 36 of FIG. 2 is replaced by an addressable electrode 42 which is downwardly curved at that stage of the operation. Such an electrode configuration can be made by deposition some or all of the material comprising addressable electrode 42 in a state of static compression, as is well known in the art of thin film fabrication. Alternatively, the membrane can be deposited on a shaped surface, such as for example on a partially exposed photoresist surface. The principal of operation is not fundamentally changed in such a case.

Figure 10:
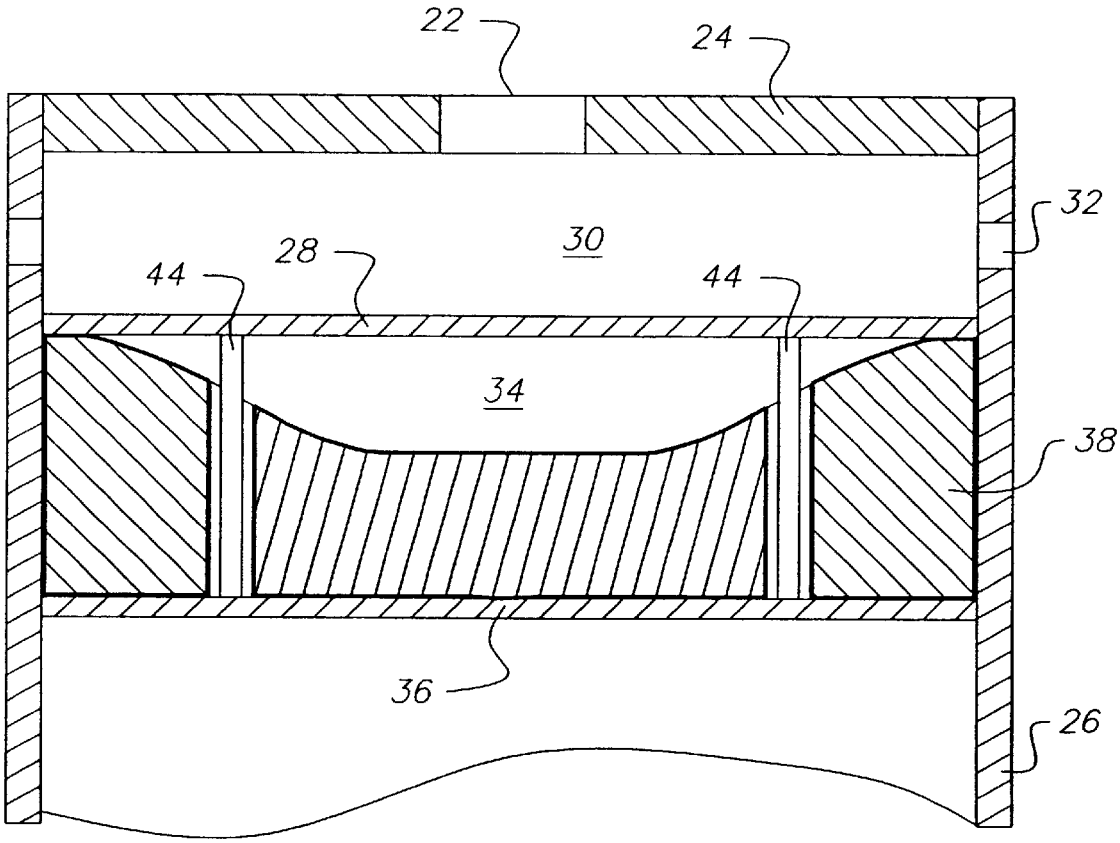
FIG. 10 is a cross-sectional view of a portion of another embodiment of the drop-on-demand liquid emission device of FIG. 1.

Still another Preferred Embodiment:

FIG. 10 depicts still another preferred embodiment of a liquid emission device in accordance with the present invention. Central coupler 40, between the upper and lower addressable electrodes 28 and 36 of FIG. 2, has been replaced in the embodiment of FIG. 10 by a plurality of couplers 44 that are radially removed from the central location. In this case, couplers 44 are posts distributed around an equal number of openings in central electrode 38. The operation is otherwise identical to that described in the discussion of FIG. 2.

Figure 11:
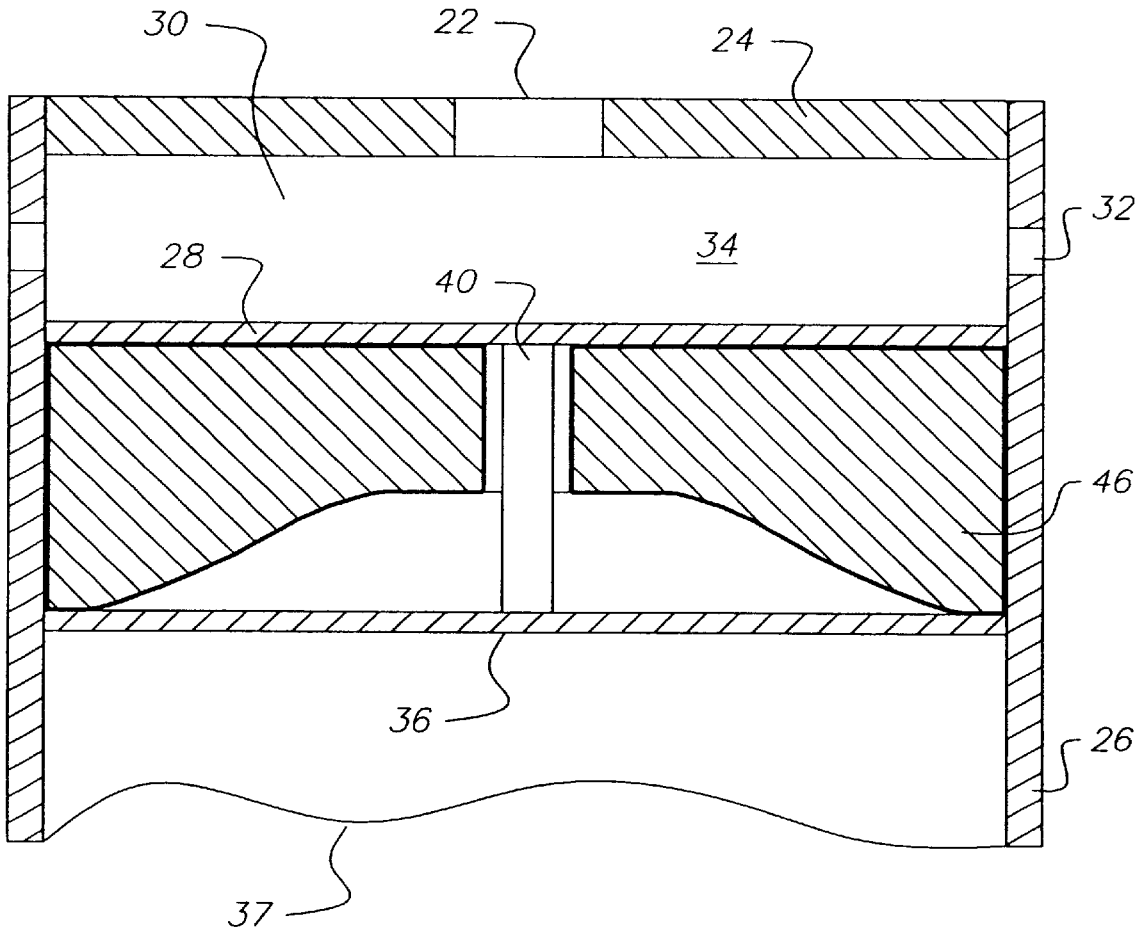
FIG. 11 is a cross-sectional view of a portion of another embodiment of the drop-on-demand liquid emission device of FIG. 1.
Figure 12:
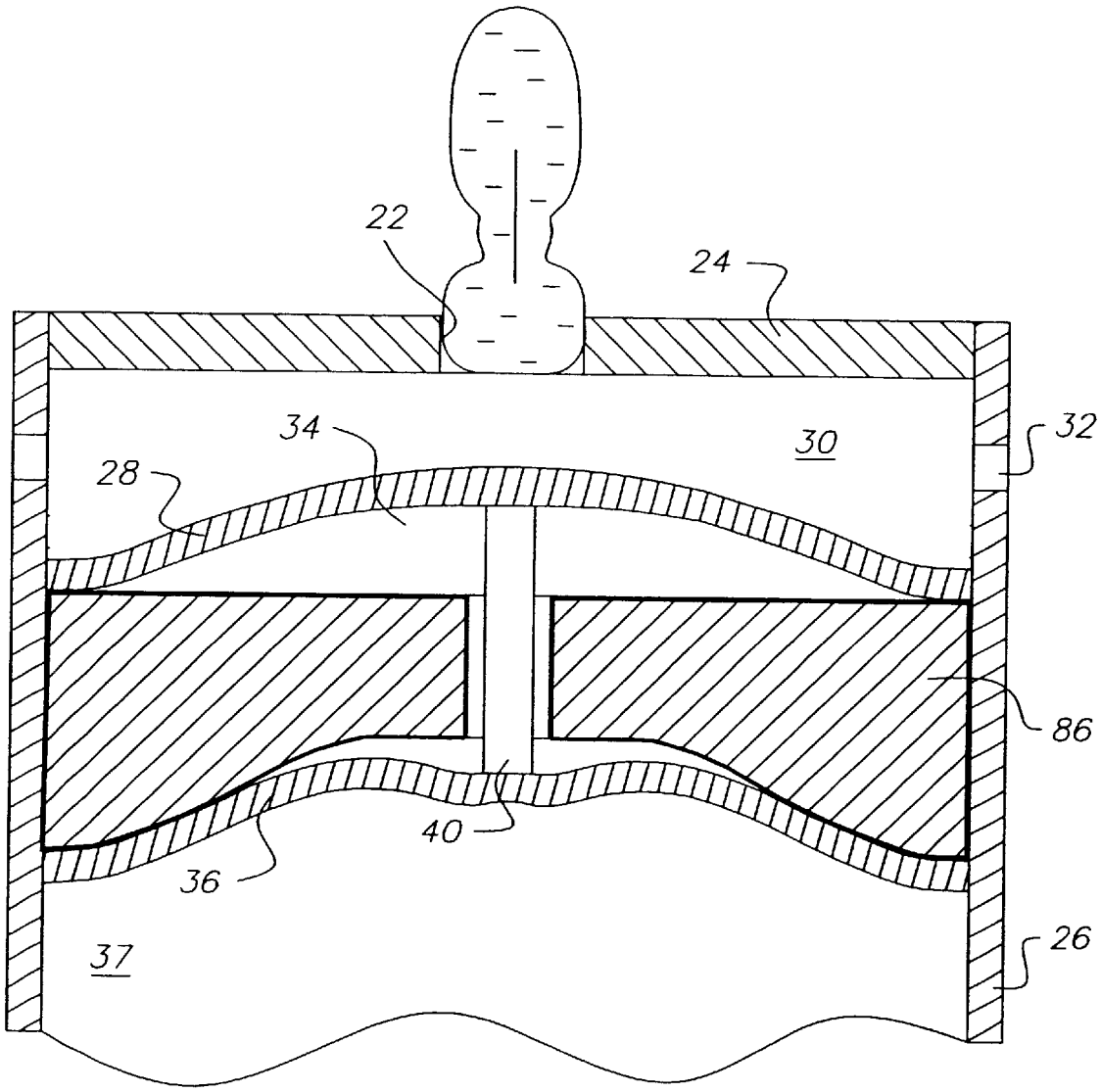
FIG. 12 is a cross-sectional view of the drop-on-demand liquid emission device of FIG. 11 shown in a first actuation stage.
Figure 13:
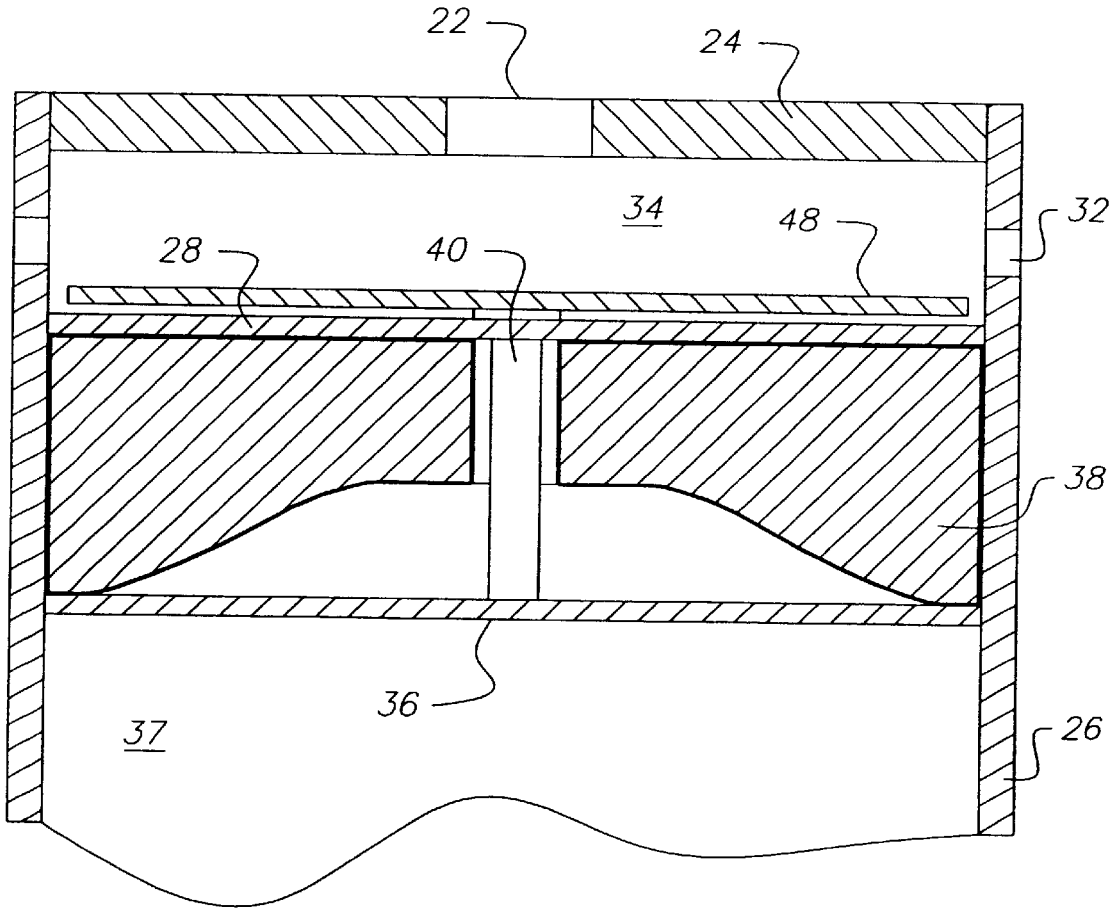
FIG. 13 is a cross-sectional view of a portion of another embodiment of the drop-on-demand liquid emission device of FIG. 1.
Figure 14:
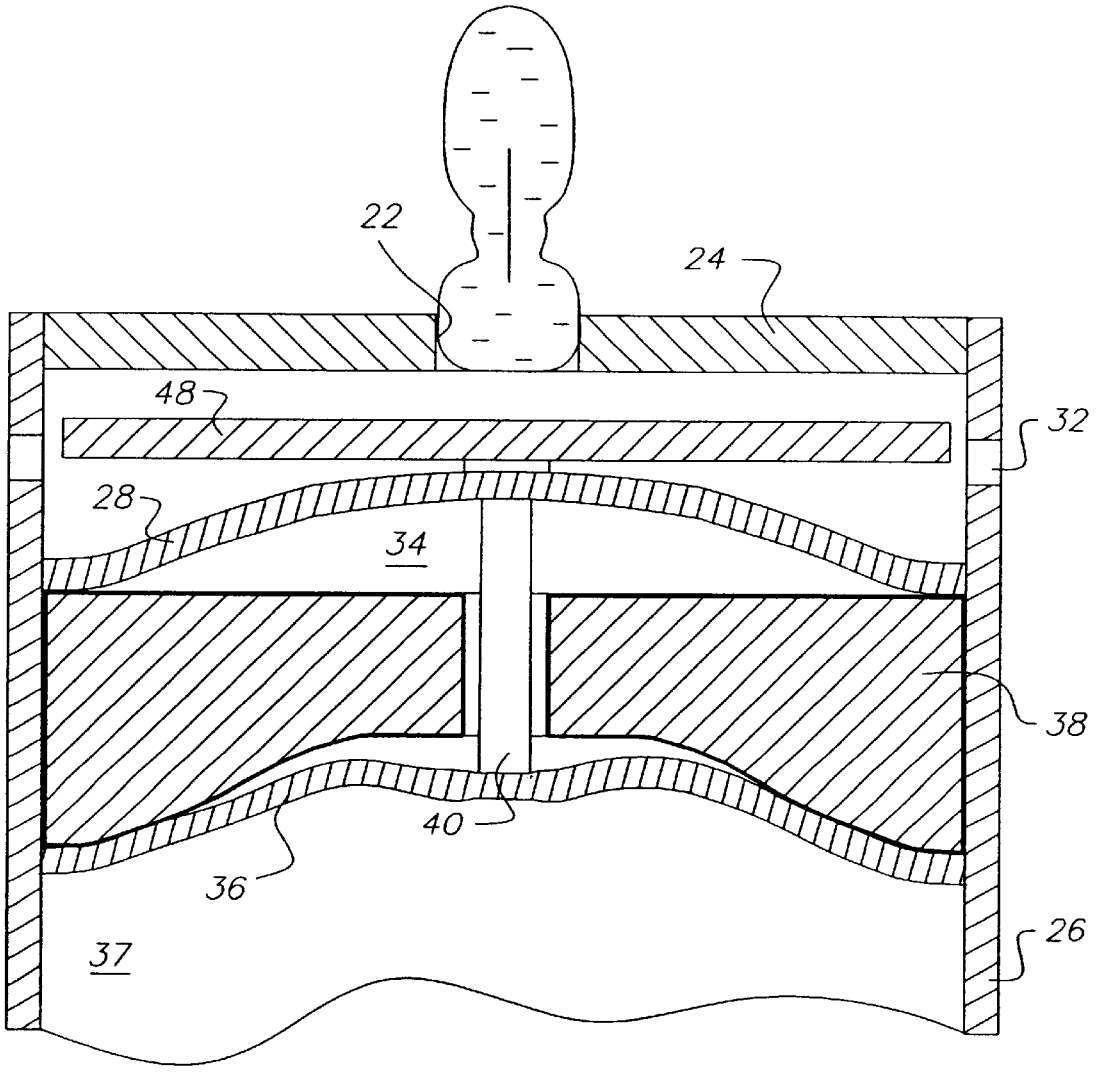
FIG. 14 is a cross-sectional view of the drop-on-demand liquid emission device of FIG. 13 shown in a first actuation stage.

Yet another Preferred Embodiment:

FIGS. 11 and 12 depict yet another preferred embodiment of a liquid emission device in accordance with the present invention. Asymmetric central electrode 46 is inverted from the orientation of central electrode 38 of the previously illustrated embodiments. That is, the central electrode has a flat surface nearest nozzle orifice 22 and an upwardly-curved bottom surface. As long as the maximum depth of the curved surface of the central electrode is precisely controlled, the minimum and maximum ink chamber volumes remain well controlled, although the sensitivity to fabrication is greater than for the above-described embodiments. However, an advantage of the inverted asymmetric central electrode shown in FIGS. 11 and 12, is that the curved shape of the addressable electrode 68 during drop ejection affords the addition of a flat ejector plate 48 as illustrated in FIGS. 13 and 14. Flat ejector plate 88 provides a more nearly flat bottom surface during liquid ejection and can act to partially occlude the refill channels during ejection, thereby increasing volumetric efficiency.

What is claimed is:

1. An emission device for ejecting a liquid drop, said device comprising:

a structure defining a chamber volume adapted to receive a liquid and having a nozzle orifice through which a drop of received liquid can be emitted;

a first electrode associated with a movable wall portion of the chamber volume defining structure such that movement of the first electrode in a first direction moves the movable wall portion to increase the chamber volume to draw liquid into the chamber volume;

a second electrode associated with the movable wall portion such that movement of the second electrode in a second direction moves the movable wall portion to decrease the chamber volume to emit a liquid drop through the nozzle orifice; and a third electrode between the first and second electrodes such that (1) application of an electrostatic charge differential between the first electrode and the third electrode moves the first electrode in said first direction to increase the chamber volume and (2) application of an electrostatic charge differential between the second electrode and the third electrode moves the second electrode in said second direction to decrease the chamber volume, said third electrode having opposed surfaces respectively facing each of said first and second electrodes, wherein:

one of said opposed surfaces of the third electrode faces one of said first and second electrodes at an angle of contact whereby movement of said one of said first and second electrodes toward the third electrode progressively increases contact between said one of said first and second electrodes and said one of said opposed surfaces of the third electrode, and the other of said opposed surfaces of the third electrode is flat.

2. An emission device for ejecting a liquid drop as defined in claim 1, wherein the angles of contact between said one of said opposed surfaces of the third electrode and said one of said first and second electrodes is less than 10 degrees.

3. An emission device for ejecting a liquid drop as defined in claim 1, wherein said one of said opposed surfaces of the third electrode is concaved away from said one of said first and second electrodes.

4. An emission device for ejecting a liquid drop as defined in claim 3, wherein the angle of contact between said one of said opposed surfaces of the third electrode and said one of said first and second electrodes is less than 10 degrees and tends to 0 degrees as said contact progressively increases.

5. An emission device for ejecting a liquid drop as defined in claim 1, wherein the emission device is a print head of an ink jet printing system.

6. An emission device for ejecting a liquid drop as defined in claim 1, further comprising a controller having:

a first state applying an electrostatic charge differential between the first electrode and the third electrode; and a second state applying an electrostatic charge differential between the second electrode and the third electrode.

7. A liquid drop emission device as set forth in claim 6 wherein the controller is adapted to provide a short dwell period between said first and second states.

8. An emission device for ejecting a liquid drop as defined in claim 1, wherein the third electrode is a ground electrode.

9. An emission device for ejecting a liquid drop as defined in claim 8, wherein the ground electrode is structurally stiff.

10. An emission device for ejecting a liquid drop as defined in claim 1, wherein the addressable electrodes are structurally connected by a rigid coupler.

11. An emission device for ejecting a liquid drop as defined in claim 10, wherein the coupler is electrically insulating.

12. An emission device for ejecting a liquid drop as defined in claim 10, wherein the coupler is formed of a conductive material having a non-conductive break therein.

13. An emission device for ejecting a liquid drop, said device comprising:

a structure defining a chamber volume adapted to receive a liquid and having a nozzle orifice through which a drop of received liquid can be emitted;

structurally coupled, separately electrically addressable first and second dual electrodes movable in a first direction to draw liquid into the chamber and in a second direction to emit a liquid drop from the chamber through the nozzle orifice; and a third electrode between the dual electrodes, said third electrode having opposed surfaces respectively facing each of said first and second electrodes at an angle of contact whereby movement of the dual electrodes in the first direction progressively increases contact between the first and third electrodes.

14. An emission device for ejecting a liquid drop, said device comprising:

a structure defining a chamber volume adapted to receive a liquid and having a nozzle orifice through which a drop of received liquid can be emitted;

a first electrode having a surface area, said first electrode being associated with a movable wall portion of the chamber volume defining structure such that movement of the first electrode in a first direction:

moves the movable wall portion to increase the chamber volume to draw liquid into the chamber volume, and increases the surface area of the first electrode to move toward a state of greater tension;

a second electrode having a surface area, said second electrode being associated with the movable wall portion such that movement of the second electrode in a second direction:

moves the movable wall portion to decrease the chamber volume to emit a liquid drop through the nozzle orifice, and decreases the surface area of the first and second electrodes whereby the first and second electrodes move toward states of lesser tension; and a third electrode between the first and second electrodes such that (1) application of an electrostatic charge differential between the first electrode and the third electrode moves the first electrode in said first direction to increase the chamber volume and (2) application of an electrostatic charge differential between the second electrode and the third electrode moves the second electrode in said second direction to decrease the chamber volume, said third electrode having opposed surfaces respectively facing each of said first and second electrodes, wherein:

one of said opposed surfaces of the third electrode faces one of said first and second electrodes at an angle of contact whereby movement of said one of said first and second electrodes toward the third electrode progressively increases contact between said one of said first and second electrodes and said one of said opposed surfaces of the third electrode, and the other of said opposed surfaces of the third electrode is flat.

* * * * *